US005455551A

United States Patent [19]

Grimes et al.

[11] Patent Number: 5,455,551

[45] Date of Patent: Oct. 3, 1995

[54] INTEGRATED TEMPERATURE SENSING DUCT SPACER UNIT AND METHOD OF FORMING

[75] Inventors: Jerry W. Grimes, Amarillo, Tex.; Morris J. Gauldin, Danville; Robert H. Hollister, South Boston, both of Va.

[73] Assignee: ABB Power T&D Company Inc., Blue Bell, Pa.

[21] Appl. No.: 60,245

[22] Filed: May 11, 1993

[51] Int. Cl.[6] ..... H01F 27/08

[52] U.S. Cl. ..... 336/60; 250/227.14; 385/13

[58] Field of Search ..... 336/60; 250/227.14, 250/227.16, 231.1; 356/73.1; 385/12, 13

[56] References Cited

U.S. PATENT DOCUMENTS

| | | | |
|---|---|---|---|
| 3,227,037 | 1/1966 | Park et al. | 88/14 |
| 3,315,160 | 4/1967 | Goodman | 324/73 |
| 3,960,017 | 6/1976 | Romanowski | 73/349 |
| 4,298,794 | 11/1981 | Snitzer et al. | 250/227 |
| 4,362,057 | 12/1982 | Gottlieb et al. | 374/4 |
| 4,420,752 | 12/1983 | Davis et al. | 340/870 |
| 4,724,316 | 2/1988 | Morton | 250/227 |
| 4,939,447 | 7/1990 | Bohnert et al. | 324/96 |
| 4,970,386 | 11/1990 | Buck | 250/227.04 |

*Primary Examiner*—Leo P. Picard
*Assistant Examiner*—L. Thomas
*Attorney, Agent, or Firm*—Woodcock, Washburn, Kurtz, Mackiewicz & Norris

[57] ABSTRACT

A method of securing a flexible temperature sensing element to a duct spacer element of the type which is commonly used in an electrical transformer includes steps of forming a groove in a surface of duct spacer element; and securing a flexible temperature sensing element within the groove so that the flexible temperature sensing element does not protrude from the groove beyond the surface in which the groove is formed. In this way, the duct spacer element and sensing element may be assembled into an electrical apparatus such as a transformer without imparting destructive mechanical forces to the sensing element. The disclosure also embraces an integrated temperature sensing duct spacer unit.

9 Claims, 4 Drawing Sheets

INTEGRATED TEMPERATURE SENSING DUCT SPACER UNIT AND METHOD OF FORMING

BACKGROUND OF THE INVENTION

1. Field of the Invention

This invention relates to the field of electro-inductive devices, such as electrical transformers. More specifically, this invention relates to an assembly for monitoring the temperature within a winding of such a device, and a method for making such an assembly.

2. Description of the Prior Art

An electrical transformer 10 such as that which is depicted in FIGS. 1 and 2 typically includes a ferrous core 12 about which a number of windings 14 are wound. As is shown in FIG. 1, a number of leads 16 are electrically connected to windings 14, in a manner that is well known to those in the industry. One type of winding 14, as shown in FIG. 2, is fabricated from a strip conductor 18, upon which insulation 20 has been deposited. A number of cooling ducts 22 are formed between adjacent layers of insulation 20 by means of a plurality of duct sticks 24 which are interposed between the adjacent layers. During normal operation, electrical transformer 10 is typically suspended in a liquid, which fills ducts 22 and provides a cooling effect to the windings 14.

In many applications, it is desirable to monitor or measure the temperature within one or more of the ducts 22 in winding 14. One way to accomplish this would be to use a standard thermocouple which is inserted into the duct 22. However, because a thermocouple is electrical in nature it might be dangerous or otherwise disadvantageous for use within an electrical transformer 10.

It is known that an optical fiber may be used to measure temperature. In one known technique, a short pulse of light, typically several nanoseconds in length and at an appropriate wavelength, is launched into one end of the fiber. As the pulse of light propagates along the fiber, it is scattered by a variety of reasons in all directions. A proportion of this scattered light makes its way back to the same end of the fiber into which the light was launched. By using some form of directional coupling of the light, this back scattered light is optically detected. The total spectrum of received back scattered radiation is dominated by Rayleigh scattering, which is not particularly sensitive to temperature. However, certain components of the scattered spectrum are sufficiently sensitive to temperature (in particular the so-called Raman spectrum) so as to provide a convenient mechanism for its measurement. One such system which is commercially available is the York Distributed Temperature Sensor System that is commercially from York Technology of Hampshire, England.

Fiber optic filament temperature sensing systems are well suited to measuring the temperature in inductive devices, because of their non-electrical nature. However, the resolution such equipment presently requires at least 7 meters of filament length. Optical fibers are relatively fragile, and are difficult to fit into a duct 22 without adversely applying mechanical stresses which could damage the filament.

It is clear that there has existed a long and unfilled need in the prior for an improved system and method which permits an optical fiber temperature measurement system to be used for measuring the internal temperature of an electro-inductive apparatus without adversely applying mechanical stresses to the optical fiber during deployment and operation.

SUMMARY OF THE INVENTION

Accordingly, it is an object of the invention to provide an improved system and method for measuring the temperature in a cooling annulus of an electro-inductive apparatus by the use of fiber optic cable.

In order to achieve the above and other objects of the invention, a method of making an inductive winding for an electrical device which has an elongate flexible temperature sensing element implanted therein includes, according to a first aspect of the invention, steps of (a) securing a flexible temperature sensing element to the surface of a duct spacer element; and (b) assembling an inductive winding using the duct spacer element so that the flexible temperature sensing element extends into a duct which is partially defined by the duct spacer element, whereby the sensing element is insulated against mechanical stresses during assembly and use.

According to a second aspect of the invention, a method of securing a flexible temperature sensing element to a duct spacer element for assembly into an electrical apparatus includes steps of (a) forming a groove in a surface of a duct spacer element; and (b) securing a flexible temperature sensing element within the groove so that the flexible temperature sensing element does not protrude from the groove beyond the surface in which the groove is formed, whereby the duct spacer element and sensing element may be assembled into an electrical apparatus without imparting destructive mechanical forces to sensing element.

According to a third aspect of the invention, a method of forming an integrated temperature sensing duct spacer unit for assembly into an electrical apparatus includes steps of (a) forming grooves in oppositely facing first and second surfaces of, respectively, separated first and second duct spacer components; (b) winding an optical fiber about the first and second duct spacer components within the grooves; (c) securing the optical fiber within the grooves; and (d) joining the first and second duct spacer components together into an integrated temperature sensing duct spacer unit.

According to a fourth aspect of the invention, an integrated temperature sensing duct spacer unit which is adapted for assembly into an electrical apparatus, includes, a duct spacer element, the duct spacer element having a groove defined in a surface thereof; and a flexible temperature sensing element secured in the groove so as not to protrude from the groove beyond the surface in which the groove is formed, whereby the duct spacer element and sensing element may be assembled into an electrical apparatus without imparting destructive mechanical forces to the sensing element.

According to a fifth aspect of the invention, an integrated temperature sensing duct spacer unit which is adapted for assembly into an electrical apparatus includes a duct spacer element, the duct spacer element having a first set of grooves defined in a first surface thereof and a second set of grooves defined in a second, oppositely facing surface thereof; and a flexible temperature sensing element wrapped about the duct spacer element and positioned in the grooves, whereby the unit may be assembled into an electrical apparatus without imparting destructive mechanical forces to the sensing element.

According to a sixth aspect of the invention, an inductive winding for an electromagnetic apparatus such as a transformer includes a core; an insulated conductor wound about the core in a plurality of layers; and a plurality of duct spacer elements, each of the duct spacer elements being positioned between two of the respective layers to define a fluid receiving coolant duct, at least one of the duct spacer elements having a flexible temperature sensing element secured thereto, whereby the sensing element is insulated against mechanical stresses during assembly and use.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
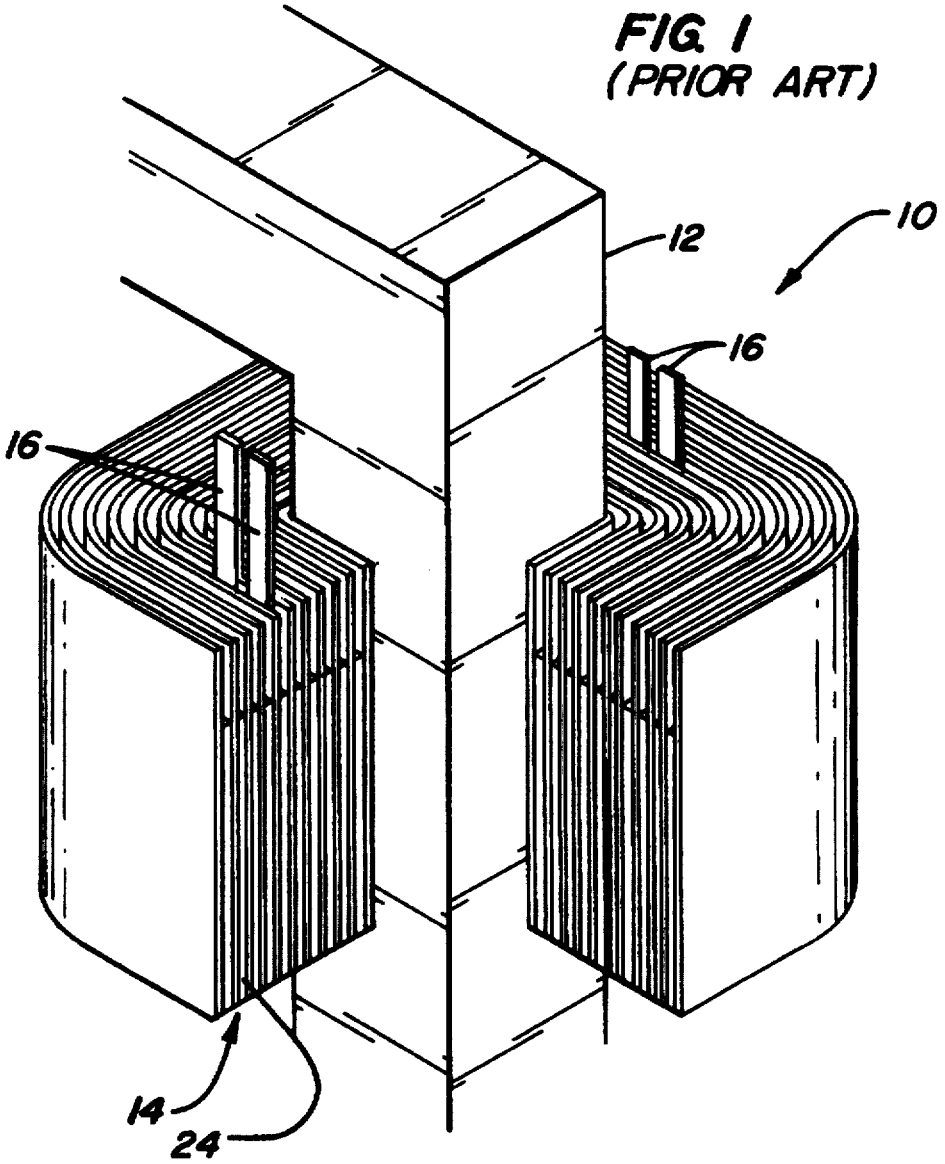
FIG. 1 (PRIOR ART)
FIG. 1 is a perspective view an electrical transformer constructed according to conventional technology.
Figure 2:
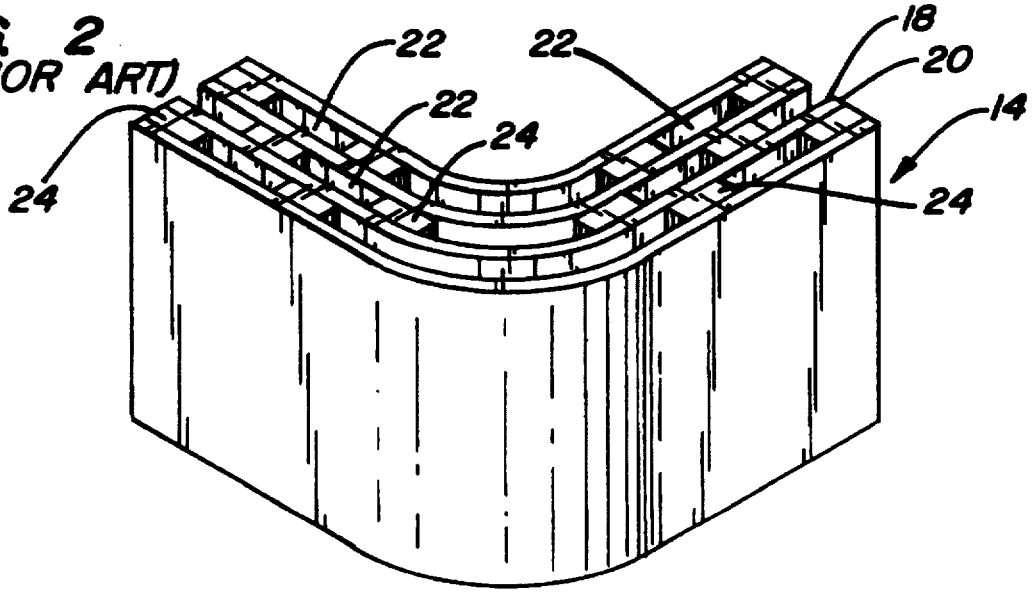
FIG. 2 (PRIOR ART)
FIG. 2 is a perspective view of a winding in the transformer that is shown in FIG. 1.
Figure 3A:
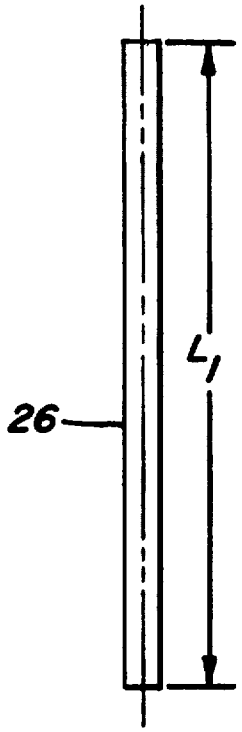
FIGS. 3(*a*)–3(*h*) are diagrammatical depictions of a preferred method for forming an integrated temperature sensing duct spacer unit according to the invention.
Figure 3B:
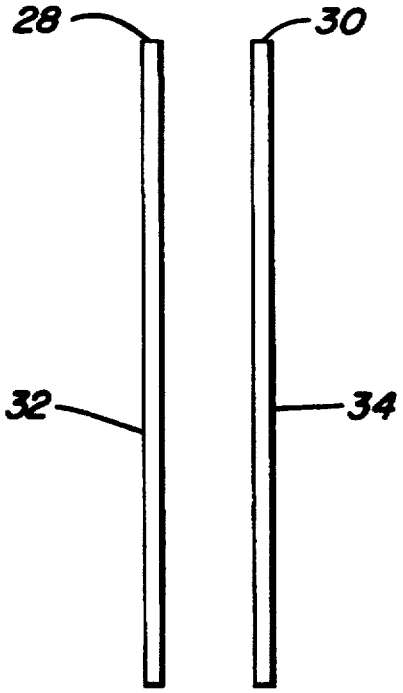
Figure 3C:
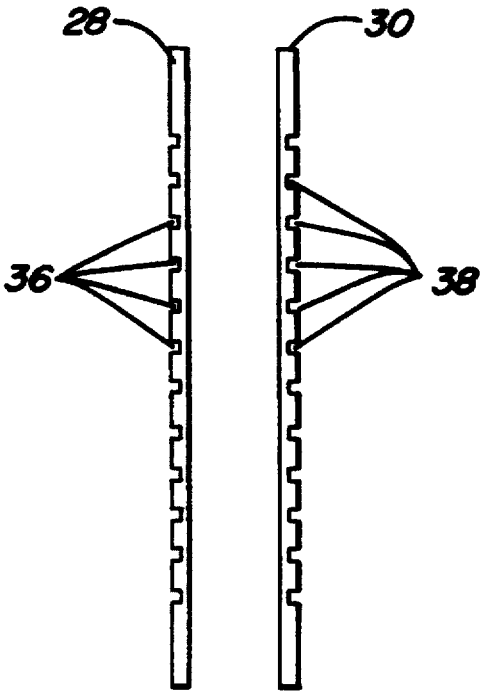
Figure 3D:
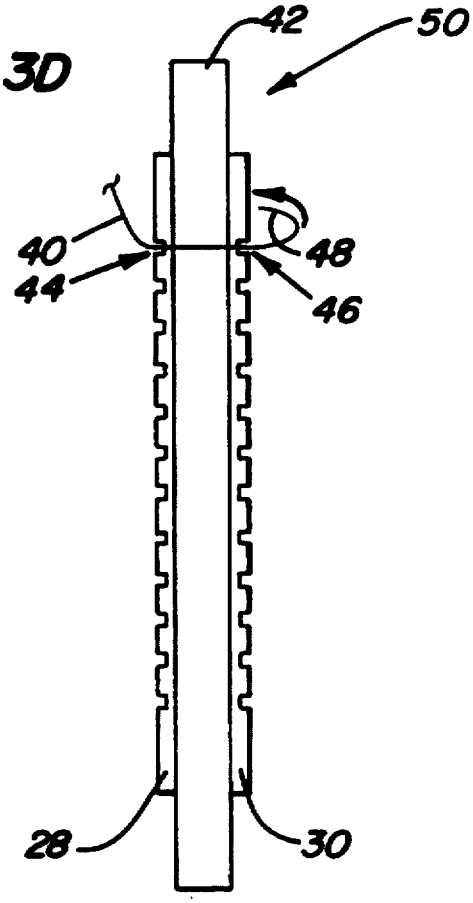
Figure 3E:
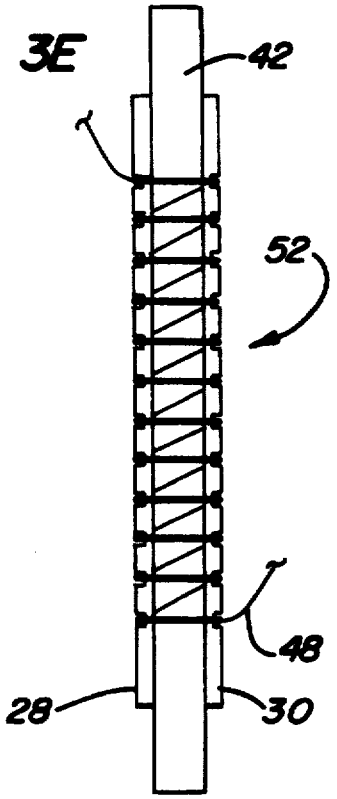
Figure 3F:
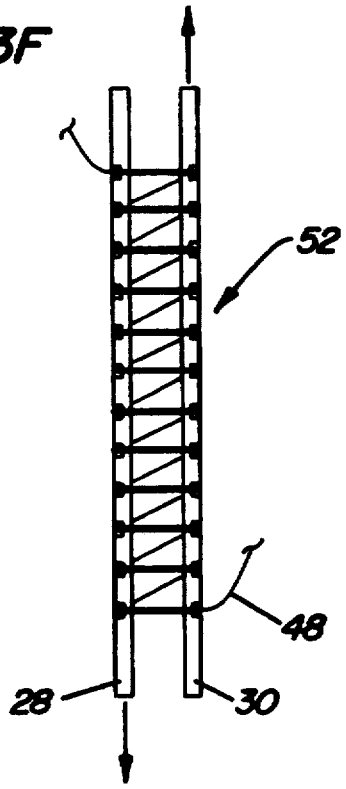
Figure 3G:
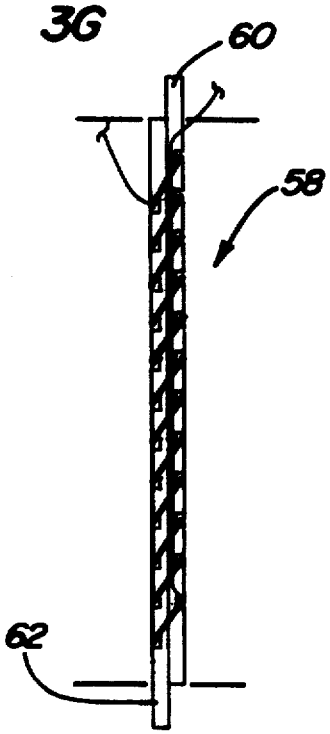
Figure 3H:
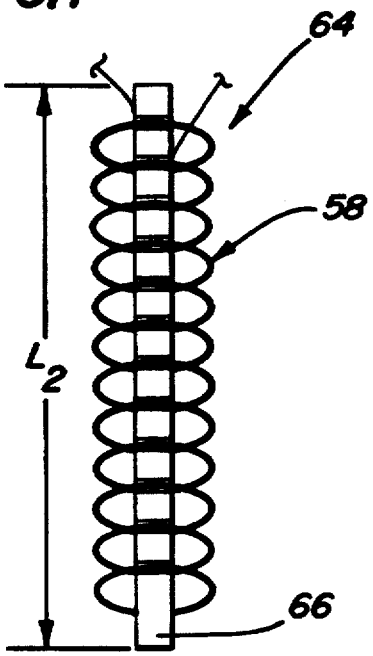

Referring now to the drawings, wherein like reference numerals designate corresponding structure throughout the views, and referring in particular to FIGS. 3(*a*)–3(*h*), a method of fabricating an integrated temperature sensing duct spacer unit according to a preferred embodiment of the invention begins with an elongated duct stick 26 having a length $L_1$.

Referring now to FIGS. 3(*a*) and 3(*b*), a method according to the preferred embodiment includes a first step of separating duct stick 26 along a center longitudinal axis thereof to create a first elongated duct spacer component 28 and a second elongated duct spacer component 30. As may be seen in FIG. 3(*b*), first duct spacer component 28 has an outwardly facing first side 32, while second duct spacer component 30 includes an outwardly facing second side 34 which is opposite to first side 32.

A plurality of grooves 36, 38 are formed, respectively, on the first and second sides 32, 34, as is illustrated in FIG. 3(*c*). Grooves 36, 38 may be formed prior to separation of the duct stick along its longitudinal axis, or after. According to the preferred embodiment of the invention, each groove 36 on first duct spacer component 28 has a corresponding groove 38 on second duct spacer component 30. Grooves 36, 38 are most preferably formed in the respective surfaces 32, 34 using a saw.

After grooves 36, 38 have been formed, a spacer element 42 is positioned between the first and second duct spacer components 28, 30, as is illustrated in FIG. 3(*d*). A flexible temperature sensing element, most preferably an optical fiber 40 having a first and 48, is then wound about the first and second duct spacer components 28, 30 so as to be situated within the respective grooves 36, 38 in such a manner that optical fiber 40 does not protrude from the respective grooves 36, 38 beyond the surfaces 28, 30 in which the grooves 36, 38 are formed. Most preferably, optical fiber 40 is wound several times about a first upper groove 44 of grooves 36 and a first upper groove 46 of grooves 38 several times, then is dropped down to the next pair of grooves, about which it is also wrapped several times. This process continues until optical fiber 40 has been wound about each pair of grooves several times, thereby creating a winding 52 as is depicted in FIG. 3(*e*). At this point, the optical fiber 40 is secured within the respective grooves 36, 38 with the use of an adhesive, which, in the preferred embodiment, is silicone-based. Alternatively, optical fiber 40 may be secured in the respective grooves 36, 38 without the stresses associated with direct exposure to an adhesive by adhering a web to the side of each component 28, 30 so as to bridge over the grooves 36, 38 and secure fiber 40 within the grooves. Preferably, this alternative process is performed with a silicone-based adhesive and an insulative paper such as is available under the Nomex brand from DuPont.

Figure 4:
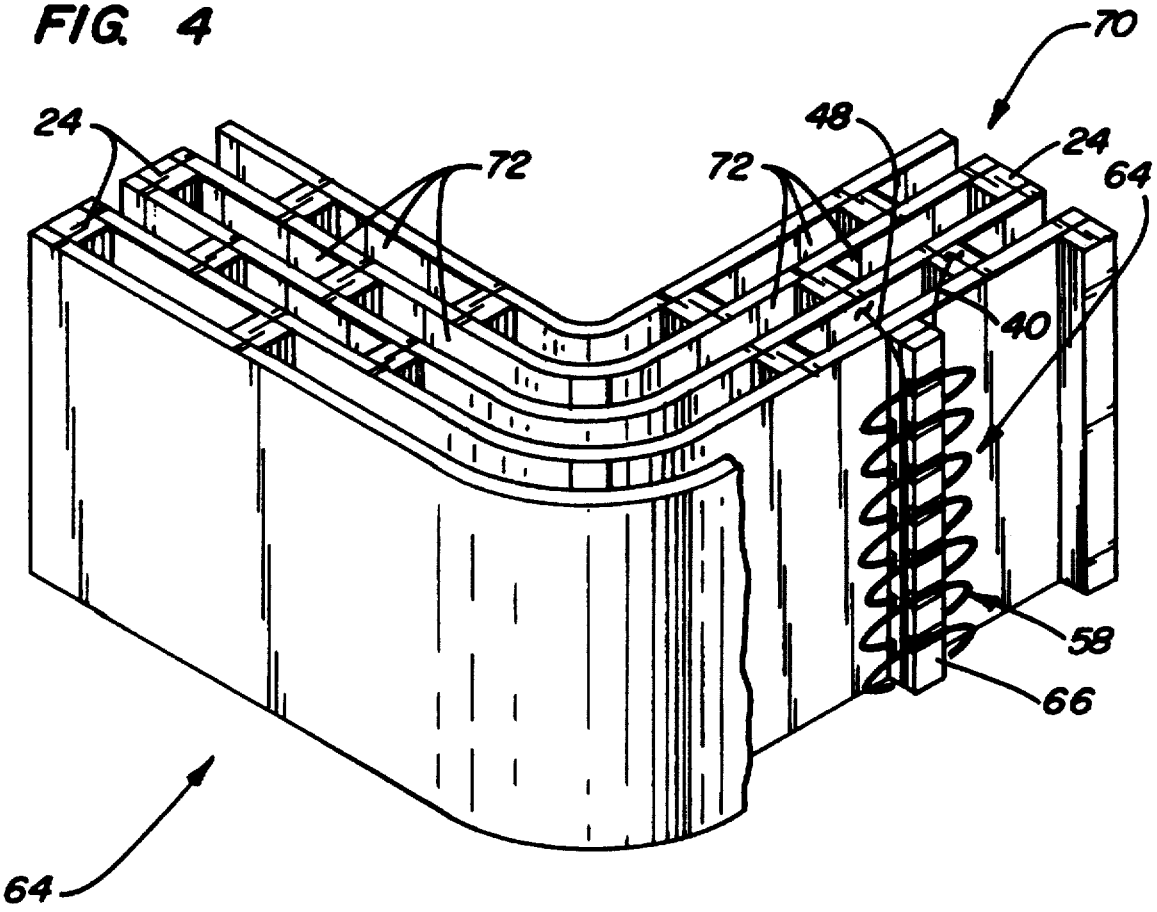
FIG. 4 is a perspective view of an inductive winding constructed according to the invention which includes a duct spacer unit as is depicted in FIG. 3(*h*).

After winding 52 is completely formed, first and second components 28, 30 are shifted axially with respect to each other as is depicted in FIG. 3(*f*). At this point, the respective duct spacer components 28, 30 are joined together in the axially shifted orientation by an adhesive, as is shown in FIG. 3(*g*). This creates a flattened winding 58 which is substantially restricted in its lateral dimension to the thickness of the combined duct spacer components 28, 30. The duct spacer components, being axially shifted, include at this point portions 60, 62 which do not overlap the other duct spacer component 30, 28. These excess portions 60, 62 are cut off to form a completed integrated temperature sensing duct spacer unit 64 having a completed duct spacer component 66 and a flattened winding 58, as may be seen in FIG. 3(*h*). The duct spacer 66 is then trimmed off to the intended length of the duct spacer in an inductive winding, shown in FIG. 4, in which the integrated temperature sensing duct spacer unit 64 is intended to be utilized. As shown in FIG. 4, the integrated temperature sensing duct spacer unit 64 is incorporated into the inductive winding 70 as any other duct spacer element would be, so that the flattened winding 58 extends into the ducts 72 which are adjacent to the duct spacer 66 of the integrated unit 64.

Accordingly, the integrated temperature sensing duct spacer unit 64 includes a duct spacer element 66 which has grooves formed in opposite surfaces thereof, and a flexible temperature sensing element, preferably an optical fiber, secured in the grooves so as not to protrude from the grooves beyond the surface in which the grooves are formed, so that the duct spacer element and sensing element may be assembled into an electrical apparatus without imparting destructive mechanical forces to the sensing element.

In addition, the inductive winding 70 includes a core as is depicted in FIG. 1, an insulated conductor wound about the core in a plurality of layers, and a plurality of duct spacer elements, each of the duct spacer elements being positioned between two of the respective layers to define a fluid receiving coolant duct, at least one 64 of the duct spacer elements having a flexible temperature sensing element 58 secured thereto, so that the sensing element is insulated against mechanical stresses during assembly and use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An integrated temperature-sensing duct spacer unit which is adapted for assembly into an electrical apparatus, comprising:

a duct spacer element, said duct spacer element having a groove defined in a surface thereof; and a flexible temperature-sensing element secured in said groove so as not to protrude from said groove beyond the surface in which the groove is formed, whereby the duct spacer element and sensing element may be assembled into an electrical apparatus without imparting destructive mechanical forces to the sensing element.

2. A unit according to claim 1, wherein said flexible temperature-sensing element comprises an optical fiber.

3. An integrated temperature-sensing duct spacer unit which is adapted for assembly into an electrical apparatus, comprising:

a duct spacer element, said duct spacer element having a first set of grooves defined in a first surface thereof and a second set of grooves defined in a second, oppositely facing surface thereof; and a flexible temperature-sensing element wrapped about said duct spacer element and positioned in said grooves, whereby the unit may be assembled into an electrical apparatus without imparting destructive mechanical forces to the sensing element.

4. An apparatus according to claim 3, wherein said grooves on said first surface are axially shifted with respect to said grooves on said second surface, whereby said temperature sensing element is wound in a relatively flat configuration about said duct spacer element.

5. An apparatus according to claim 3, wherein said temperature sensing element comprises an optical fiber.

6. An inductive winding for an electromagnetic apparatus such as a transformer, comprising:

a core;

an insulated conductor wound about said core in a plurality of layers;

a plurality of duct spacer elements, each of said duct spacer elements being positioned between two of said respective layers to define a fluid-receiving coolant duct, at least one of said duct spacer elements having a flexible temperature-sensing element secured thereto, whereby the sensing element is insulated against mechanical stresses during assembly and use.

7. An inductive winding according to claim 6, wherein said at least one duct spacer element has a first set of grooves defined in a first surface thereof and a second set of grooves defined in a second, oppositely facing surface thereof and said flexible temperature sensing element is wrapped about said duct spacer element and positioned in said grooves, whereby the unit may be assembled into an electrical apparatus without imparting destructive mechanical forces to the sensing element.

8. An apparatus according to claim 7, wherein said grooves on said first surface are axially shifted with respect to said grooves on said second surface, whereby said temperature sensing element is wound in a relatively flat configuration about said duct spacer element.

9. An apparatus according to claim 6, wherein said temperature sensing element comprises an optical fiber.

* * * * *